United States Patent [19]

Lacombe

[11] 4,270,175

[45] May 26, 1981

[54] APPARATUS FOR DIVIDING A SEGMENT OF VARIABLE LENGTH INTO EQUAL PARTS

[75] Inventor: Pierre Lacombe, Orléans, France

[73] Assignee: Fonderie et Ateliers des Sablons, Saint Jean-Le-Blanc, France

[21] Appl. No.: 973,911

[22] Filed: Dec. 28, 1978

[30] Foreign Application Priority Data

Dec. 30, 1977 [FR] France ..... 77 39839

[51] Int. Cl.[3] ..... G06G 7/16; G06G 7/48; G06J 1/00

[52] U.S. Cl. ..... 364/562; 235/92 DN; 364/850

[58] Field of Search ..... 364/605, 561, 560, 562, 364/850, 109, 110; 340/347 NT; 235/92 DN, 92 MP; 137/3, 88

[56] References Cited

U.S. PATENT DOCUMENTS

| | | | |
|---|---|---|---|
| 3,537,102 | 10/1970 | Baratto | 364/561 X |
| 3,594,783 | 7/1971 | Bullock | 364/561 X |
| 3,649,826 | 3/1972 | Larsson et al. | 364/829 X |
| 3,895,356 | 7/1975 | Kraus | 364/562 X |

FOREIGN PATENT DOCUMENTS

| | | | |
|---|---|---|---|
| 1221090 | 7/1968 | United Kingdom | 364/605 |

OTHER PUBLICATIONS

Aasnaes et al., "Integrating Ramp Analog-to-Digital Converter", IBM Technical Disclosure, vol, 11, No. 4, Sep. 1968, p. 386.

*Primary Examiner*—Joseph F. Ruggiero
*Attorney, Agent, or Firm*—Scully, Scott, Murphy & Presser

[57] ABSTRACT

Apparatus for dividing a segment of variable length into equal parts employing any whole number as a divisor. The apparatus comprises means for realizing the segment by a difference in distance separating a movable point from a fixed reference point, marking means for successively marking when the movable point is displaced in relation to the fixed point within the interval of a segment, successive divisions with their numeration in parts, and means for tying the numerical marking during movement of the movable point, relative to the fixed point, by a linear function of the first degree. The invention is especially useful for providing a mixture starting with a formulation given in parts.

6 Claims, 3 Drawing Figures

APPARATUS FOR DIVIDING A SEGMENT OF VARIABLE LENGTH INTO EQUAL PARTS

BACKGROUND OF THE INVENTION

The present invention relates to an apparatus to divide a segment of variable length into equal parts using any whole number as a divisor.

The invention also has for an object the application of apparatus of that nature for the provisions of mixtures of liquid products, for example, mixtures of paints in which the different components are proportioned in parts of the mixture.

More specifically, the invention has for its goal:

a system for forming a segment of determined length by a difference in distance between a movable point and a fixed point;

dividing this segment into equal parts by any whole number as divisor, which can be numerically marked;

successively marking, when the movable point is displaced relative to the fixed point within the interval of a segment, successive divisions with their numeration in parts.

To accomplish this, the invention provides apparatus for numerically marking, in which the numerical marking is tied to the movement of the movable point, relative to the fixed point, by a linear function of the first degree, according to the formula: $y=ax+b$ in which:

y is the result furnished by the marking;

a is a constant representing the ratio between divisor and the total length of the segment; and x is the position of the movable point relative to the fixed point.

According to one characteristic of the invention, the movable point is connected to a circuit for delivering a voltage which varies linearly as a function of the displacement of the movable point; this voltage is treated by a digital/analog converter to a double slope of integration, operating by comparison to a reference of variable external voltage permitting one to act on said parameter a.

According to another characteristic of the invention, one such apparatus comprises:

a first transducer allowing the generation of an electrical voltage proportionate to the maximum difference in distance between the fixed point and the movable point, i.e., proportionate to the size of the segment which is to be divided into parts;

a second transducer allowing the generation of an electrical voltage proportionate to the difference in distance between the fixed point and the movable point when the latter is displaced in the interval of the segment; these two means can consist in the said first means in the case wherein one inserts in memory information furnished by the first means and wherein an appropriate switching system is provided;

an integrator comprising in a known manner an integrating capacitor;

and a counter wherein the count capacity and/or the frequency of count are adjusted according to the function of a divisor by which the segment is divided, with the counter effectuating the computation of the discharge time of the integrating capacitor;

a display element permitting one to display the result of the composition when the latter has been terminated;

a switching system which allows the realization of a succession of function sequences during the displacement of the movable point relative to the fixed point.

One sequence of function comprises:

charging a capacitor by the voltage provided by the first transducer within a time equal to a counting cycle of the counter;

discharging the capacitor by subtracting from the charge on the capacitor, the voltage provided by the second transducer;

computing the discharge time of the capacitor until the time the voltage thereacross is dissipated, this during a second cycle of computation;

displaying the count in the counter at the end of the computation of the discharge; and beginning a new sequence at the end of the second cycle of computation.

In the application of the apparatus of the invention to the volumetric proportioning of liquid parts, the segment of variable length is provided by the distance which separates the extremity of a measuring rod at the level and the base of the container of the proportioned material.

One marks the divisor number selected for the highest total desired of liquid to be prepared, for example 1000 for a proportioning in thousandths.

The measuring rod is then displaced from the base of the container of the proportioned material up to the highest total of liquid to be prepared, the marking will indicate successive fractions, from 0 to 1000 (and even higher in the case of additional thousandths to be added again).

One manner of carrying out the invention is described hereinafter, by way of a nonlimitating example, with reference to the attached drawings in which.

Figure 1:
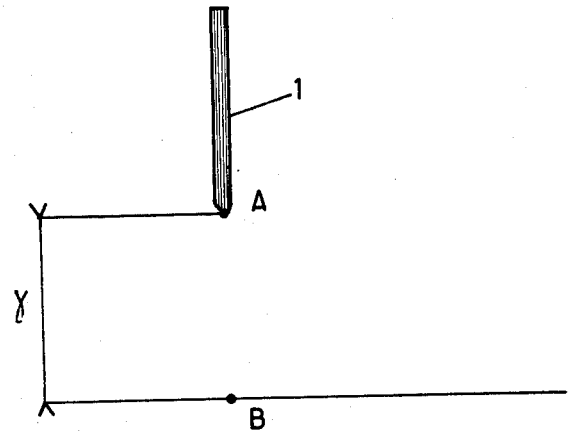
FIGS. 1 and 2 are schematic representations allowing an illustration of the problem which the invention undertakes to solve.
Figure 2:
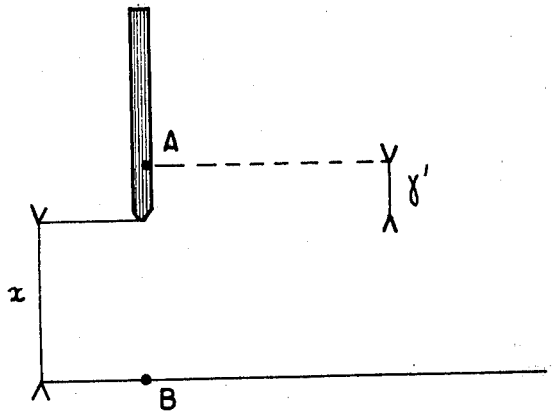

With reference to FIGS. 1 and 2, the segment which is to be divided is provided by the distance $\gamma$ which separates the extremity A of a rod 1 and a fixed point B which may be a point situated on the base of a container, to the right of stick 1.

The problem which the invention attempts to solve is the division of this segment by any divisor number, for example 2000, and doing it in such a manner that for each of the positions of the extremity of rod 1, in the interval of this segment, a system of numerical marking indicating the fraction, between 0 and 2000, corresponding to this position.

On FIG. 2 the extremity of rod 1 is displaced by a value $\gamma'$ relative to point A and is located at a height x from point B. The following relationships can therefore be established:

$$x=n(\gamma/D)$$

D being the selected divisor (for example 2000);

n being the number of parts equal to $\gamma/D$;

it being clear that it is the number n which the apparatus desires to mark.

Figure 3:
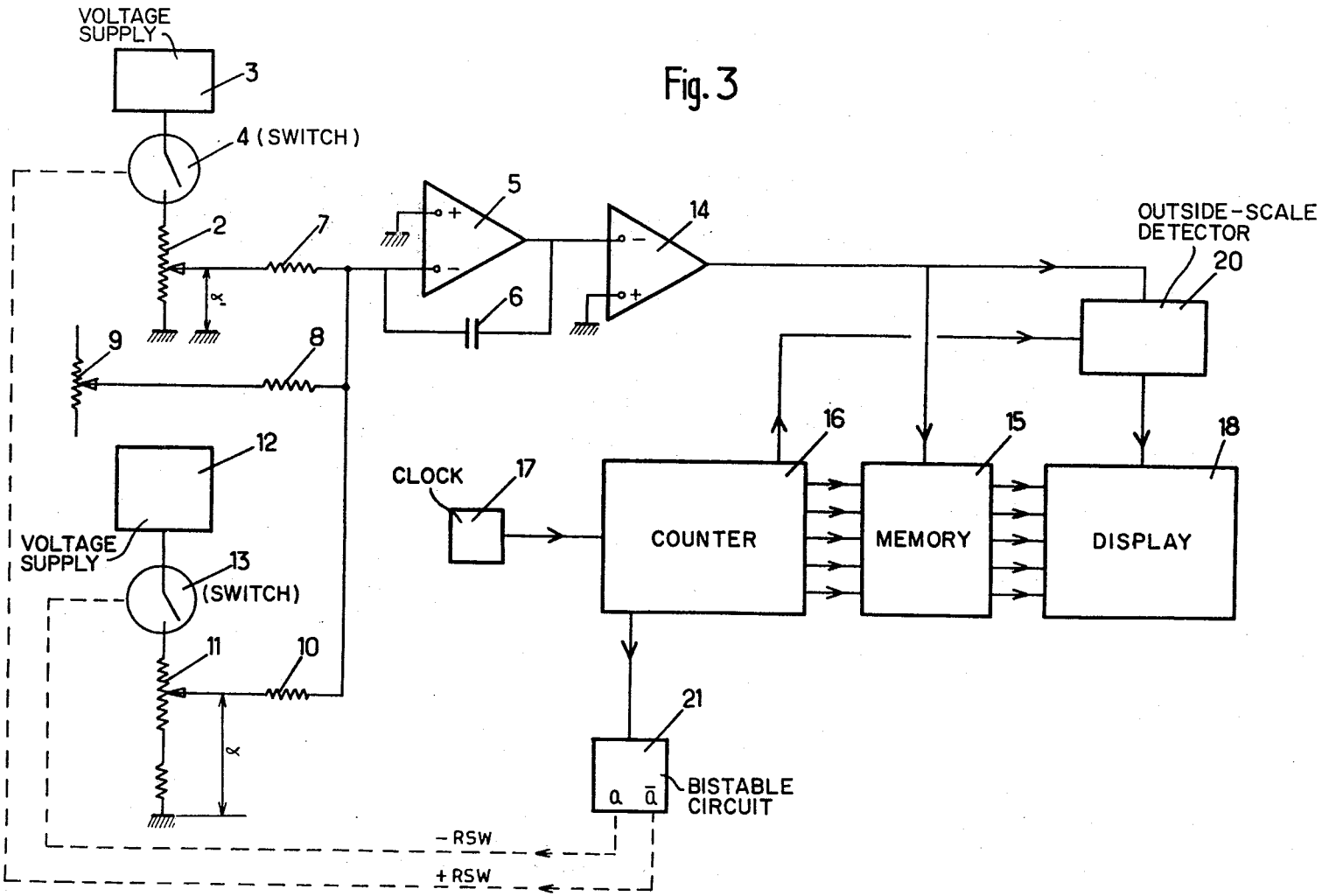
FIG. 3 is a schematic diagram of the principal components of a circuit for dividing, in equal parts, a segment of variable length, according to the invention.

This result can be obtained by means of apparatus shown in FIG. 3.

This apparatus comprises a first measuring potentiometer 2, for example, a multi-winding potentiometer positioned by the measuring rod, and allowing the generation of a voltage proportionate to the distance $\gamma'$ previously mentioned.

This potentiometer 2 is supplied with voltage from a positive reference voltage supply 3 through the intermediary of an electronic switch 4. The movable contact of potentiometer 2 is connected through a resistor 7 to the negative input of an operational amplifier 5 connected in an integrating mode by means of a capacitor 6 in a feedback circuit.

The negative input terminal of the operational amplifier 5 is also connected;

first through a resistor 8 to the movable contact of potentiometer 9 from a setting of 0, and secondly through a resistor 10 to the movable contact of potentiometer 11 carried by the rod and furnishing a voltage proportional to the distance $\gamma$ previously mentioned.

This potentiometer 11 is supplied with a source of voltage from a negative reference voltage 12 through an electronic switch 13.

The output of operational amplifier 5 is connected to a comparator circuit 14, which is in turn connected to the transfer gating terminal of memory 15. Memory 15 receives inputs from a counter 16 which is driven by a clock 17, and its output is coupled to a display unit 18.

The output of comparator 14 is also connected to an outside-the-scale detector 20 which receives information from counter 16, and which effectively controls the display unit 18 to produce a blinking thereof.

The counter 16 also operates a bistable circuit 21 which effectuates the control of electronic switches 4 and 13.

The functioning of the circuit is as follows.

Initially switch 4 is in its closed state. Accordingly, the voltage on the movable contact of potentiometer 2 is a signal proportional to the position $\gamma'$ of the contact, and therefore of the measuring rod 1. This voltage charges the integrating circuit 5, 6, during which counter 16 counts the pulses delivered by clock 17 (which may have a frequency of 20 KHz). When counter 16 reaches the count 1999, its passage to 0000 causes a change in the state of bistable circuit 21, thereby opening switch 4 (+RSW) and closing switch 13 (−RSW).

At this moment, the voltage on the contact of potentiometer 11 for the scale setting ($\gamma$) causes integrator 5, 6 to discharge (in a shorter period than the charging time because the voltage supplied by source 12 is higher in absolute value than that from source 3). When integrator 5, 6 is completely discharged, it causes a reversal of the output of comparator 14, which causes a transfer of the exact count in counter 16 (for example 1293) to memory 15, also erasing any previous count therein.

Counter 16 continues to count, and in its passage to a count of 0000, the system returns to a starting state, and the operative cycle is repeated. The duration of one operative cycle is about a fifth of a second in one embodiment of the invention.

The state of counter 16 is transferred into memory, and in the example below signifies:

$$x/\gamma = 1293/2000$$

$\gamma$ being the voltage delivered by potentiometer contact 11 from the scale setting. It may be transposed to $1293 = (2000/\gamma)\ x$ in the general case, $y = (2000/\gamma)\ x$ if one is given that $2000/\gamma = a \rightarrow y = ax$ y being the reading ($0000 \leqq y \leqq 1999$)

x being the position of the rod 1 relative to point B.

Nothing remains but to introduce a low value to shift to zero the input to the integrator, by potentiometer 9, to compute the term b and obtain the function $y = ax + b$. (The term a is therefore adjustable while acting upon $\gamma$.)

In the case where integrator 5, 6 does not have the time to completely discharge during the second portion of the cycle, the circuit of outside-the-scale detector 20 erases the indications which are no longer valid, and causes a blinking of the display unit. This situation arises if voltage x is greater than $\gamma$, i.e., when the rod 1 is in a higher position than that which corresponds to 2000 divisions. A circuit, not shown, allows the indication of the least sign before being able to perform the resetting of zero without ambiguity. The input circuits are constructed in a conventional manner, and are not shown. The display unit 18 is constructed of four individual displays, each having seven electroluminescent diodes in a conventional manner.

From a strictly electronics point of view, the accuracy of the system is dependent upon various parameters, such as the stability of the temperature base and the linearity of the integrator, and it can attain an accuracy of 0.1% under average conditions of use and 0.01% when utilizing specially designed circuits. There is no reason to expect that these levels of performances will deteriorate with time.

Of course the apparatus according to the invention can be utilized for numerous other applications such as the mixture of liquid products starting with a formula given in parts of mixture.

It can for example allow, in the measurement of a distance, the conversion of one measurement system to another.

What is claimed is:

1. Apparatus for dividing in equal parts, a segment of variable length by any whole number divisor characterized in that it comprises:

(a) means allowing the realization of said segment by a difference in distance separating a movable point and a fixed point;

(b) marking means for marking successively, when the movable point is displaced relative to the fixed point, in the interval of a segment, the successive divisions with their numeral representation in part; and (c) means to tie the numerical marking to the movement of the movable point, relative to the fixed point, by a linear function of the first degree, in the form $$y = ax + b$$

y being the result furnished by the marking;

a being a constant representative of the ratio between the divisor and the total length of the segment; and x is the position of the movable point relative to the fixed point;

said tying means including an arrangement in which the movable point is coupled to a transducer which delivers a linearly varying voltage proportional to the displacement of said movable point, and that the voltage is directed to an analog/digital converter with a double ramp of integration operating by reference to an external reference voltage allowing said parameter a to be acted upon.

2. Apparatus for dividing in equal parts, a segment of variable length by any whole number divisor characterized in that it comprises:

(a) means allowing the realization of said segment by a difference in distance separating a movable point and a fixed point;

(b) marking means for marking successively, when the movable point is displaced relative to the fixed point, in the interval of a segment, the successive divisions with their numeral representation in part; and (c) means to tie the numerical marking to the movement of the movable point, relative to the fixed point, by a linear function of the first degree, in the form $$y=ax+b$$

y being the result furnished by the marking;

a being a constant representative of the ratio between the divisor and the total length of the segment; and x is the position of the movable point relative to the fixed point;

said typing means comprising, a first transducer for generating an electrical voltage proportional to the maximum difference between the fixed point and the movable point when the movable point is displaced in the interval of the segment;

an integrator comprising an integrating capacitor;

a counter in which the count capacity and/or the count frequency are adjusted in function of the divisor to divide the segment, this counter effectuating the computation of the time of discharge of the integrating capacitor;

a marking element for marking the result of the computation after termination thereof;

a switching system for a succession of sequences of functioning, each of these sequences comprising:

charging a capacitor by the voltage produced by the first transducer, during a time equal to the counting cycle of the counter;

discharging the condenser by subtracting the voltage produced by the second transducer;

computing the time of discharge of the capacitor until the voltage thereacross is dissipated during the course of the second cycle of computation;

marking the state of the counter at the end of said discharge;

beginning a new sequence at the end of the second cycle of computation.

3. Apparatus for dividing in equal parts, a segment of variable length by any whole number divisor characterized in that it comprises:

(a) means allowing the realization of said segment by a difference in distance separating a movable point and a fixed point;

(b) marking means for marking successively, when the movable point is displaced relative to the fixed point, in the interval of a segment, the successive divisions with their numeral representative numeration in part; and (c) means to tie the numerical marking to the movement of the movable point, relative to the fixed point, by a linear function of the first degree, in the form $$y=ax+b$$

y being the result furnished by the marking;

a being a constant representative of the ratio between the divisor and the total length of the segment; and x is the position of the movable point relative to the fixed point;

said tying means comprising a first potentiometer carried by a rod and supplied with a source of voltage of positive reference through the intermediary of an electronic switch, the movable contact of this potentiometer being connected to the negative input terminal of an operational amplifier mounted in an integrating mode, said negative input terminal being also connected to a second potentiometer of zero setting, and also to a movable contact of a third potentiometer coupled to said rod and coupled to a source of voltage of negative reference through a second electronic switch, the output of said operational amplifier being connected to a comparator coupled to the transfer input terminal of a memory coupled in a gating function to a counter coupled to a display unit, the counter also controlling a bistable element which effectuates control of said electronic switches.

4. Apparatus according to claim 3, characterized in that said comparator is coupled to an outside-the-scale detector which receives information from the counter and which commands the erasure of the display unit and the blinking of the output thereof.

5. Apparatus according to claim 1 or 2 or 3, for use in the volumetric proportioning of liquids.

6. Apparatus according to claim 1 or 2 or 3, for use in the proportioning of a mixture of paints.

* * * * *